US007377613B2

(12) United States Patent
Yamazaki et al.

(10) Patent No.: US 7,377,613 B2
(45) Date of Patent: May 27, 2008

(54) DETERMINATION OF INK EJECTION AMOUNT ERROR FOR A PRINTER

(75) Inventors: Satoshi Yamazaki, Nagano-ken (JP); Toshiaki Kakutani, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 11/043,497

(22) Filed: Jan. 25, 2005

(65) Prior Publication Data

US 2005/0190216 A1 Sep. 1, 2005

(30) Foreign Application Priority Data

Jan. 28, 2004 (JP) ..... 2004-019268

(51) Int. Cl.
*B41J 29/393* (2006.01)

(52) U.S. Cl. ..... 347/19

(58) Field of Classification Search ..... 347/19, 347/14, 41; 358/504
See application file for complete search history.

(56) References Cited

U.S. PATENT DOCUMENTS

| | | | | |
|---|---|---|---|---|
| 6,109,722 | A * | 8/2000 | Underwood et al. | 347/19 |
| 6,714,673 | B1 * | 3/2004 | Ohta | 382/167 |
| 2007/0064043 | A1 * | 3/2007 | Tsuchiya et al. | 347/19 |

FOREIGN PATENT DOCUMENTS

| | | | |
|---|---|---|---|
| JP | 05-162338 | | 6/1993 |
| JP | 10-000795 | | 1/1998 |
| JP | 10-323978 | | 12/1998 |
| JP | 2005212171 | * | 8/2005 |

OTHER PUBLICATIONS

Abstract of Japanese Patent Publication No. 05-162338, Pub. Date: Jun. 29, 1993, Patent Abstracts of Japan.
Abstract of Japanese Patent Publication No. 10-000795 Pub. Date: Jan. 6, 1998, Patent Abstracts of Japan.
Abstract of Japanese Patent Publication No. 10-323978 Pub. Date: Dec. 8, 1998, Patent Abstracts of Japan.

* cited by examiner

*Primary Examiner*—Lamson Nguyen
(74) *Attorney, Agent, or Firm*—Martine Penilla & Gencarella, LLP

(57) ABSTRACT

A plurality of same ink nozzle arrays are provided, and multiple color patches are printed with mutually different dot recording rates respectively using one of the same ink nozzle arrays. Color specification value of the plurality of color patches is measured for each same ink nozzle array. The ink ejection amount error of each same ink nozzle array is determined based on the color specification values of the plurality of color patches for each same ink nozzle array. It is also possible to select among the plurality of color patches a preferable color patch that is closest to a specified reference color patch, and to determine the ink ejection amount error from the dot recording rate of the preferable color patch.

11 Claims, 11 Drawing Sheets

Test pattern TP (first embodiment)

Relationship of dot recording rate DR and ink weight W for color patches that reproduce a specific density Small ← Dot recording rate DR → Large

| DR (%) | 9.7 | 9.8 | 9.9 | 10.0 | 10.1 | 10.2 | 10.3 |
|---|---|---|---|---|---|---|---|
| W (%) | 103 | 102 | 101 | 100 | 99 | 98 | 97 |

Large ← Ink weight W → Small

STRUCTURE OF PRINT DATA GENERATION UNIT 250 (FIRST EMBODIMENT)

Test pattern TP (first embodiment)

Relationship of dot recording rate DR and ink weight W for color patches that reproduce a specific density Small ← Dot recording rate DR → Large

| DR (%) | 9.7 | 9.8 | 9.9 | 10.0 | 10.1 | 10.2 | 10.3 |
|---|---|---|---|---|---|---|---|
| W (%) | 103 | 102 | 101 | 100 | 99 | 98 | 97 |

Large ← Ink weight W → Small

Fig.7A

Test pattern TP1 for head 320B (second embodiment)

| DR | 9.7 | 9.8 | 9.9 | 10.0 | 10.1 | 10.2 | 10.3 |
|---|---|---|---|---|---|---|---|
| 320A → | 10.0 | 10.0 | 10.0 | 10.0 | 10.0 | 10.0 | 10.0 |
| 320B → | 9.7 | 9.8 | 9.9 | 10.0 | 10.1 | 10.2 | 10.3 |
| 320A → | 10.0 | 10.0 | 10.0 | 10.0 | 10.0 | 10.0 | 10.0 |
| 320B → | 9.7 | 9.8 | 9.9 | 10.0 | 10.1 | 10.2 | 10.3 |
| 320A → | 10.0 | 10.0 | 10.0 | 10.0 | 10.0 | 10.0 | 10.0 |

} Cyan

↑ Color match (DR = 9.8 %, W = 102 %)

Fig.7B

Test pattern TP2 for head 320C (second embodiment)

| DR | 9.7 | 9.8 | 9.9 | 10.0 | 10.1 | 10.2 | 10.3 |
|---|---|---|---|---|---|---|---|
| 320A → | 10.0 | 10.0 | 10.0 | 10.0 | 10.0 | 10.0 | 10.0 |
| 320C → | 9.7 | 9.8 | 9.9 | 10.0 | 10.1 | 10.2 | 10.3 |
| 320A → | 10.0 | 10.0 | 10.0 | 10.0 | 10.0 | 10.0 | 10.0 |
| 320C → | 9.7 | 9.8 | 9.9 | 10.0 | 10.1 | 10.2 | 10.3 |
| 320A → | 10.0 | 10.0 | 10.0 | 10.0 | 10.0 | 10.0 | 10.0 |

} Cyan

↑ Color match (DR = 9.9 %, W = 101 %)

STRUCTURE OF PRINT DATA GENERATION UNIT 250a (THIRD EMBODIMENT)

DETERMINATION OF INK EJECTION AMOUNT ERROR FOR A PRINTER

CROSS-REFERENCE TO RELATED APPLICATIONS

The present application claims the priority based on Japanese Patent Application No. 2004-19268 filed on Jan. 28, 2004, the disclosure of which is hereby incorporated by reference in its entirety.

BACKGROUND OF THE INVENTION

1. Field of the Invention

The present invention relates to technology for calibrating ink ejection amount for a printer that forms ink dots on a printing medium while scanning a print head unit in the main scan direction.

2. Description of the Related Art

Inkjet printers print images by ejecting ink from nozzles provided on a print head. The same as with other types of printers, for inkjet printers as well, there is always a pursuit of improvements in quality and improvements in printing speed. In recent years, the inkjet printer image quality has improved at about the same level as silver salt photographs, so improvement of the printing speed is a bigger problem.

To improve printing speed, the easiest measure is to increase the number of nozzles per color. As a method of increasing the nozzle count, it is possible to use a method that uses a plurality of print heads, for example.

However, it is normal for the ink ejection amount from a print head nozzle to contain manufacturing discrepancies. JP5-162338A and JP10-795A each describes a method of calibrating ink ejection amount that takes this kind of error into consideration.

Calibration of ink ejection amount is performed according to an ink ejection amount error. However, sufficient mechanisms were not implemented for determining an ink ejection amount error with respect to each print head. In particular, after assembling printers which comprise a plurality of print heads, there were cases when it was not easy to determine an ink ejection amount error for each of the print heads of that printer. Also, this kind of problem is not limited to printers that use a plurality of printing heads, but generally is a problem that is common to printers that comprise a printing head unit that has a plurality of nozzle arrays for ejecting same ink (called a "same ink nozzle array").

SUMMARY OF THE INVENTION

An object of the present invention is to provide a technology that can determine an ink ejection amount error without requiring excess work.

In one aspect of the present invention, there is provided a method of determining an ink ejection amount error for a printer that comprises a print head unit having a plurality of same ink nozzle arrays for ejecting same ink. The method comprises: (a) printing a plurality of color patches with mutually different dot recording rates using one same ink nozzle array, with respect to each of the plurality of same ink nozzle arrays; (b) measuring color specification values of this plurality of color patches for each same ink nozzle array; and (c) determining the ink ejection amount error of each same ink nozzle array based on the color specification values of the plurality of color patches for each same ink nozzle array.

With this method, the ink ejection amount error is determined based on the color specification value of the color patch printed using each of the same ink nozzle arrays, so it is possible to determine the ink ejection amount error without requiring excessive work.

In another aspect of the present invention, the method comprises: (a) printing a plurality of color patches with mutually different dot recording rates using one same ink nozzle array, with respect to each of the plurality of same ink nozzle arrays; (b) selecting a preferable color patch with respect to each same ink nozzle array among the plurality of color patches printed with the same ink nozzle array, the preferable color patch having a same color as a predetermined reference color patch; and (c) determining the ink ejection amount error of each same ink nozzle array based on the dot recording rate with which the preferable color patch is printed.

With this method, the ink ejection amount error is determined based on the dot recording rate of the preferable color patch that has the same color as the reference color patch, so it is possible to determine the ink ejection amount error without requiring excessive work. It is also possible to easily determine the ink ejection amount error even after assembly of the printer if the color patches are printed using that printer.

It should be noted that the present invention can be implemented in a variety of embodiments such as an ink ejection amount error determination method and device, an ink amount data calibration method and device using the ink ejection amount error, a print data generation method and device, a printer driver, a printing method and printing device, computer programs for realizing the functions of these methods or devices, the recording media on which this computer program is recorded, and data signals embedded in a carrier wave including this computer program.

These and other objects, features, aspects, and advantages of the present invention will become more apparent from the following detailed description of the preferred embodiments with the accompanying drawings.

BRIEF DESCRIPTION OF THE DRAWINGS

FIGS. 7A and 7B show an example of test patterns used in the second embodiment.

DESCRIPTION OF THE PREFERRED EMBODIMENT

Preferred embodiments of the present invention will be described in the following sequence.

Figure 1:
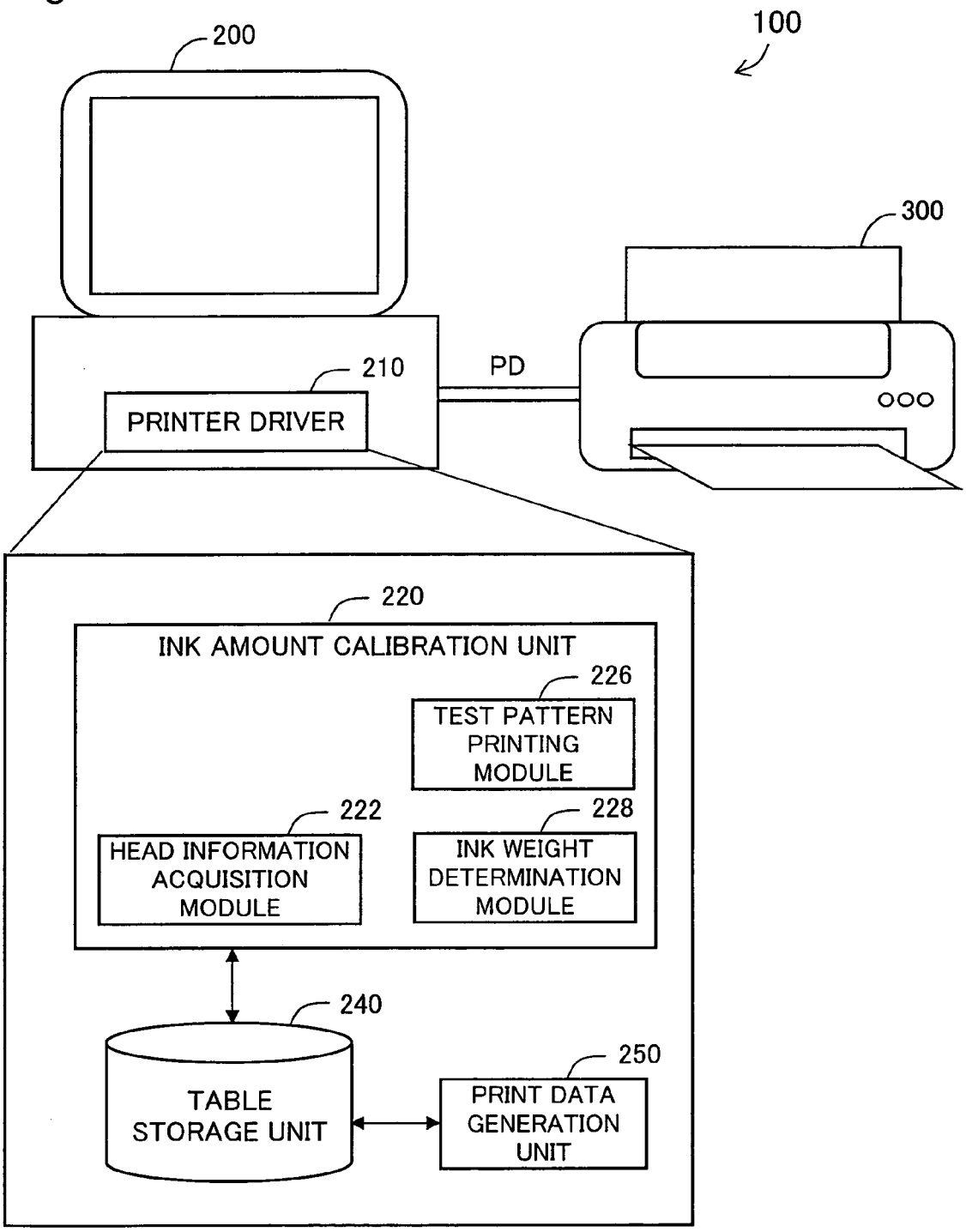
FIG. 1 schematically shows a printing system as a embodiment of the present invention.

A. First Embodiment:

B. Second Embodiment:

C. Third Embodiment:

D. Variations:

A. First Embodiment:

FIG. 1 schematically shows a printing system 100 as a first embodiment of the present invention. This system 100 comprises a computer 200 and a color printer 300. The computer 200 comprises a printer driver 210 for generating the print data PD to supply to the printer 300.

The printer driver 210 comprises an ink amount calibration unit 220, a table storage unit 240, and a print data generating unit 250. The table storage unit 240 stores various types of tables such as a color conversion lookup table used by the print data generating unit 250. The ink amount calibrating unit 220 has a function of correcting these tables.

The ink amount calibrating unit 220 comprises a head information acquisition module 222 for acquiring a head information H1D from the printer 300, a test pattern printing module 226 for printing a test pattern (described later), and an ink weight determination module 228 that determines weight of inks ejected from a print head based on the printed test pattern. This "ink weight" is a value indicative of an error of the ink ejection amount of a print head, and hereafter will also be called "ink weight information." The calibration of the print head ink ejection amount is performed based on this ink weight.

For some types of the printer 300, various types of information relating to the print head (called "head information") are stored in the memory within the printer 300. There are also cases when this head information includes information relating to the ink ejection amount error. In this case, it is possible to perform ink amount calibration using this head information by the head information acquisition module 222 acquiring the head information from the printer 300, without printing a test pattern.

Figure 2:
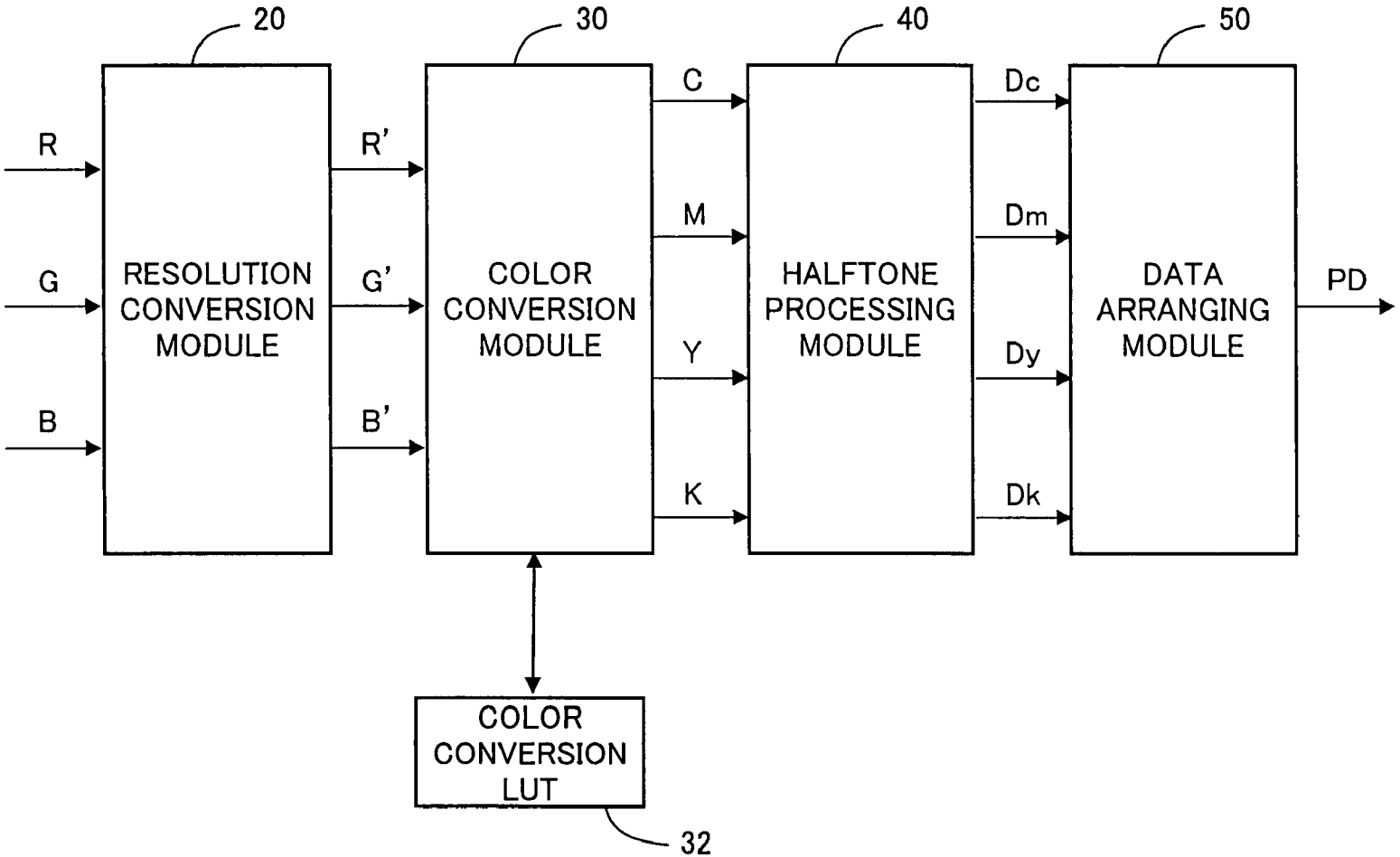
FIG. 2 is a block diagram that shows the structure of a print data generating unit of the first embodiment.

FIG. 2 is a block diagram that shows the structure of the print data generation unit 250 for the first embodiment. The print data generation unit 250 comprises a resolution conversion module 20, a color conversion module 30, a halftone processing module 40, and a data arranging module 50. The resolution conversion module 20 converts the resolution of input color image data R, G, and B to a resolution suitable for the process in and after the color conversion module 30. The color conversion module 30 converts the color image data R', G', and B' after the resolution conversion to ink amount data C, M, Y, K using a color conversion lookup table 32. The halftone processing module 40 generates dot forming data Dc, Dm, Dy, and Dk, each of which represents a dot formation state at each printing pixel, by executing halftone processing for each of the inks. The data arranging module 50 arranges these dot formation data Dc, Dm, Dy, and Dk in a suitable order, and outputs them as the print data PD.

The printer driver 210 is normally implemented as a program stored in a storage unit, such as a hard disk, in a computer. The print data PD created by the printer driver is supplied to an external printer. There are also cases when the printer driver is implemented within the printer. In this case, the print data PD created by the printer driver is supplied to a printing unit or printing mechanism within the printer. It should be noted that in the case of a printer driver implemented within a computer as well, it is possible to call the external printer a "printing unit." Therefore, the printer driver typically has a function of generating print data to be supplied to a printing unit based on color image data. It is possible to omit the resolution conversion module 20 or the data arranging module 50 from the printer driver. It is also possible to realize part or all of the printer driver using hardware circuitry.

Figure 3:
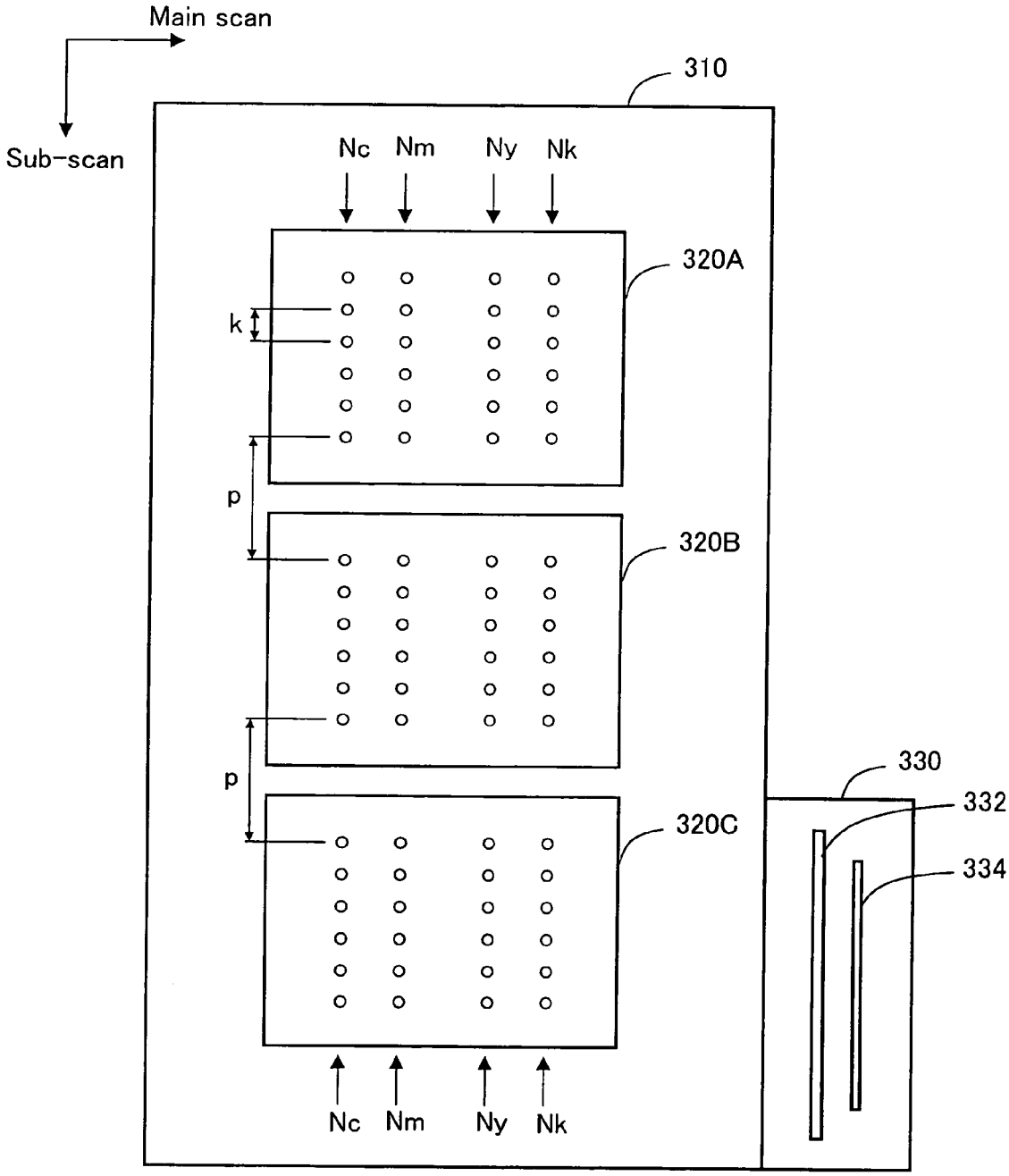
FIG. 3 schematically shows a print head unit and a scanner unit.

FIG. 3 schematically shows the bottom surface of a printing head unit 310 installed in the printer 300. The printing head unit 310 has three printing heads 320A to 320C. These printing heads 320A to 320C are of the same design with the same nozzle arrays, and after being individually manufactured, are assembled onto the printing head unit 310.

The printing head 320A has a cyan ink nozzle array Nc, a magenta ink nozzle array Nm, a yellow ink nozzle array Ny, and a black ink nozzle array Nk. Each of the nozzle arrays Nc, Nm, Ny and Nk is respectively aligned with a fixed pitch k in the sub-scan direction, and has the same nozzle count. The nozzle pitch k is set as an integral multiple of the printing resolution in the sub-scan direction. The four nozzle arrays Nc, Nm, Ny, and Nk within one printing head 320 are positioned along the main scan direction.

The three printing heads 320A to 320C are aligned along the sub-scan direction. The gap p between the adjacent printing head nozzle arrays can be arbitrarily set to a value that is an integral multiple of the printing resolution in the sub-scan direction. It is possible to arrange printing heads 320A to 320C in zigzag fashion to make the gap p smaller. For example, it is possible to make gap p smaller by arranging the second printing head 320B further to the right than the other two printing heads 320A and 320C. Also, as the printing head unit 310, it is possible to use a head unit that has a plurality of printing heads that have mutually different nozzle arrays.

The scanner unit 330 is provided adjacent to the print head unit 310, and moves together with the print head unit 310 in the main scan direction. The scanner unit 330 has a linear light source 332 for illuminating the printed test pattern, and a line sensor 334 for reading the test pattern. It is preferable that the scanner unit 330 be fixed so as to be detachable from the print head unit 310. The reason for this is so that the light source 332 and the line sensor 334 are not discolored by the ink.

Figure 4:
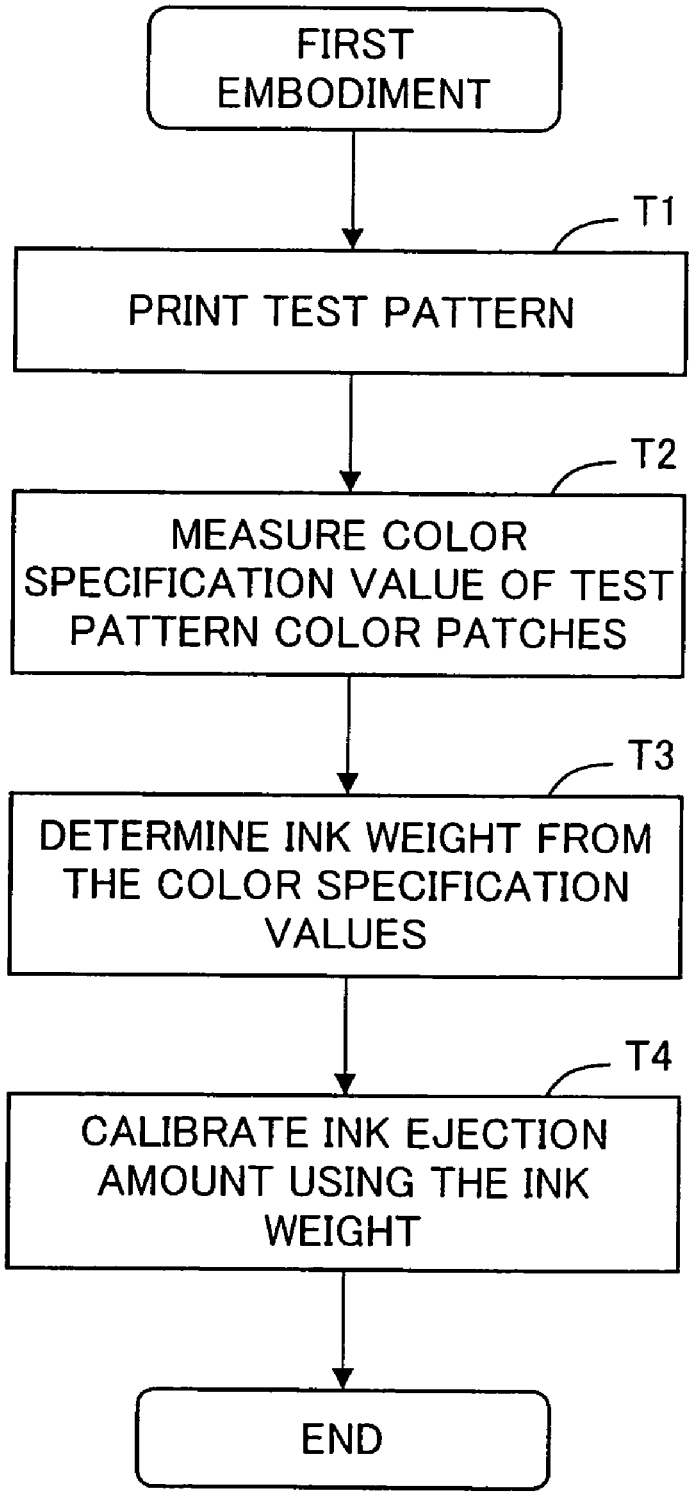
FIG. 4 is a flow chart that shows the procedure for calibrating the ink ejection amount for the first embodiment.

FIG. 4 is a flow chart that shows the procedure for calibrating the ink ejection amount in the first embodiment. In step T1, the test pattern printing module 226 (FIG. 1) causes the printer 300 to print a test pattern by transmitting test pattern print data, which is prepared in advance, to the printer 300.

Figures 5A, 5B:
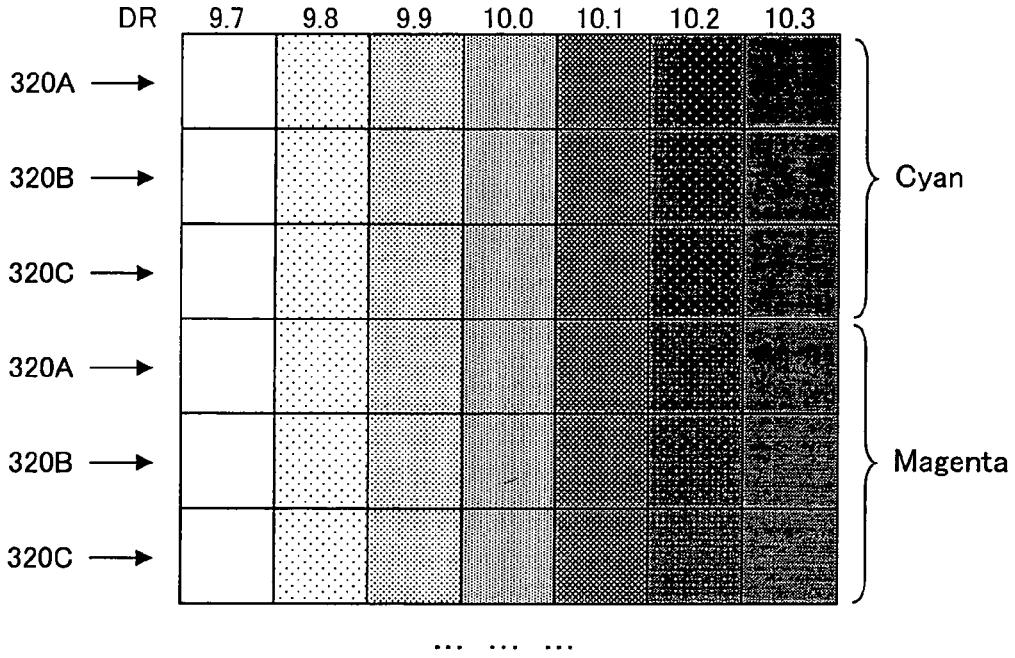
FIGS. 5A and 5B show an example of a test pattern used in the first embodiment.

FIG. 5A shows an example a test pattern TP used in the first embodiment. Each rectangle shows one color patch. Each color patch is printed using the respective specified dot recording rates DR while using only one type of ink and using only one print head (in other words, one nozzle array). Here, the "dot recording rate" means a ratio of recording of ink dots on pixels. For example, a dot recording rate of 100% means recording ink dots on all pixels, and a dot recording rate of 50% means recording ink dots on half the pixels. The value of the dot recording rate DR depicted at the top of FIG. 5A shows the dot recording rate of one column of the color patches below that. The values of these dot recording rates DR are preferably actually printed on the test pattern.

The topmost seven color patches (also called a "color patch row") of FIG. 5A are printed using only the cyan nozzle array of the first print head 320A. The dot recording rates DR of these seven color patches have values which are sequentially increased by a fixed difference (here it is 0.1%) from the left side toward the right. The difference of the dot recording rates of these seven color patches is set to a value that corresponds to 1/100 of a specific reference dot recording rate, which is 10% in this example. Since the reference dot recording rate is 10%, 1/100 of this value is 0.1% in units of the dot recording rate.

The value of the reference dot recording rate DR is preferably set to a value for which the ink dots do not overlap with each other on the print medium. The reason for this is that if ink dots overlap with each other, the ink ejection amount error is negated to some degree with overlapping of dots, making it difficult to detect the effect of the ink ejection amount error. The reference dot recording rate is preferably in the range of 5% to 30%, more preferably in the range of 5% to 20%, and most preferably in the range of 5% to 15%. Also, the difference in the dot recording rate DR between adjacent color patches can be set to any value, but it is preferable to set the difference to a value in the range of 0.5/100 to 2/100 of the reference dot recording rate.

The second color patch row from the top in FIG. 5A is printed using only the cyan nozzle array of the second print head 320B, and the third color patch row from the top is printed using only the cyan nozzle array of the third print head 320C. Also, the fourth to sixth color patch rows from the top are printed in the same manner with the first through third color patch rows using magenta ink. It should be noted that the same kind of color patch rows are respectively printed with yellow ink and black ink as well.

FIG. 5B shows the relationship between the dot recording rate DR of a color patch having a fixed density and an ink weight W. The "ink weight W" is the value that indicates an error from the standard value (design value) of the ink ejection amount of each nozzle. In this example, the ink weight W is a relative value of an actual ejection amount expressed in percent form where the standard ejection amount is 100%. For example, when the value of the ink weight W of the cyan nozzle array of a certain print head is 98%, the ejection amount of this cyan nozzle array is only 2% less than the standard value. Each combination of the dot recording rate DR and the ink weight W in the same column in FIG. 5B will reproduce a color patch that has the same density or lightness. Here, the ink weight W for the standard dot recording rate DR (=10%) is assumed to be 100%. For example, when the ink weight W is 101% and the dot recording rate DR is set to 9.9%, a color patch with the same density as when W=100% and DR=10% is reproduced. The relationship in FIG. 5B will be used when determining a suitable ink weight W of each print head using a test pattern.

It should be noted that as the ink weight W, it is also possible to use a value indicative of a correction amount for the ink ejection amount instead of information indicative of the error. As this correction amount, it is possible to use the inverse number 1/W of the ink weight W noted above, for example. The correction value of the ink ejection amount and the ink weight W have a common feature that they represent the ink ejection amount error.

In step T2 in FIG. 4, a color specification value of each color patch within the printed test patch is measured. With this embodiment, the measurement is performed using the scanner unit 330 (FIG. 3). For example, when the user inserts a sheet on which a test pattern is printed into the platen (not illustrated) position of the printer 300 and presses a specific operation button of the printer 300, the measurement is executed using the scanner unit 330. It is also possible to measure a calorimetric value of each color patch using an independent calorimeter. Note that in this specification, "color specification value" means a value that quantitatively expresses a color, and this has a broad meaning that is not limited to the CIE calorimetric values (e.g. the CIE-RGB value or the CIE-Lab value), but also includes device dependent color image data (e.g. the scanner RGB value). In this sense, the scanner unit 330 is also one kind of "color measurement devices." A typical color specification value includes three components. However, in step T2, as a color specification value, it is possible to acquire all the three components, or to acquire only one of these components (e.g. the lightness value L).

In step T3, the ink weight determination module 228 determines an ink weight W for each nozzle array of each print head (FIG. 5B) using the color specification value of each color patch. Because of this, the ink weight determination module 228 first selects a color patch that has a preferable color specification value (called a "preferable color patch") from among the plurality of color patches created with one ink of one nozzle array (this method will be described later). The ink weight W is determined using the dot recording rate of this preferable color patch and the relationship in FIG. 5B. For example, among a plurality of color patches printed using a cyan nozzle array of a certain print head, when the preferable color patch is printed with the dot recording rate DR of 9.8%, the ink weight W for the cyan nozzle array is determined to be 102%.

Selection of the preferable color patch may be performed using various methods such as those noted below.

(A1) Among a plurality of color patches printed using one print head, a color patch having a color specification value that is closest to the predetermined reference color specification value is selected as the preferable color patch. As the "predetermined reference color specification value," it is possible to use an absolute color specification value such as CIE-Lab values, or to use a color specification value which is measured for a color patch printed with a reference printer that ejects standard ink amounts. As the "color patch having a color specification value that is closest to the predetermined reference color specification value," it is possible to select a color patch whose color specification value directly obtained by measurement is closest to the reference color specification value, or a color patch whose color specification value that takes into consideration a measurement error is closest to the reference color specification value. The color specification value that takes into consideration a measurement error may be obtained by plotting a graph of the relationship between the dot recording rate and the color specification value, and to obtain its approximation line or approximation curve. With this method (A1), the ink weight W of each of the print heads is determined based on a fixed reference color specification value that does not depend on the individual printer, so it is possible to reduce variation of the color reproducibility between printers.

(A2) A reference print head is selected to print a reference color patch, and for the other print head(s), among a plurality of color patches printed with each print head, a patch that has a color specification value closest to the value of the reference color patch is selected as the preferable color patch. In FIG. 5A, for example, it is possible to use a color patch of DR=10.0% printed by the first print head 320A as the reference color patch.

(A3) A reference print head is selected to print a plurality of reference color patches, and for the other print head(s), among a plurality of color patches printed with each print head, a patch that has a color specification value closest to the average color specification value of the reference color patches is selected as the preferable color patch. As the average color specification value for the reference print head, for example, it is possible to use the average color specification value of the central five color patches among the seven color patches printed with the first print head 320A.

(A4) A patch that has a color specification value closest to the average color specification value of all the color patches printed with the same ink that is subject to testing is selected as the preferable color patch of each print head. For example, the average color specification value is calculated using all the color patches printed with one of the cyan nozzle arrays of three print heads, and a preferable color patch for each print head is selected whose color specification value is closest to the average color specification value.

For these methods (A1) through (A4), as the decision criterion of the "closet color specification value," it is possible to use conditions such as when the CIE color difference ΔE is the smallest, or when a difference ΔL of the CIE-Lab lightness value L is the smallest. Generalization of the methods (A3) and (A4) suggests that it is possible to obtain an average value of the color specification values of at least part of the color patches selected in advance among the plurality of color patches printed with each ink, and to select a preferable color patch for each print head using the average color specification value as a reference.

By working in this way, when each of the ink weights W in relation to each nozzle array of each print head is determined, that ink weight W is registered in the printer driver 210 (FIG. 1) as part of the head information. Also, this ink weight W is preferably stored in non-volatile memory within the printer 300.

In step T4 of FIG. 4, the ink amount calibration unit 220 executed calibration of the ink ejection amount using the ink weight W determined in step T3. This calibration, for example, may be executed by correcting the ink amounts C, M, Y, and K that are the output values of the color conversion lookup table 32 (FIG. 2), and creating a calibrated color conversion lookup table. It is also possible to use the color conversion lookup table 32 as is without correction, and to provide a correction module that corrects the ink amounts C, M, Y, and K that are output from the color conversion module 30.

In the first embodiment described above, the ink weight or the ink ejection amount error of each nozzle array of each print head is determined based on the color specification values of color patches that are respectively printed with each nozzle array and each print head, so it is possible to determine the ink ejection amount error of each nozzle array of each print head relatively easily without requiring excess processing time. It is also possible to print test patterns that include many color patches using a printer in which a plurality of print heads are incorporated, so it is also possible to perform the ejection amount test even after assembly of a printer without requiring the ejection amount test in advance for each individual print head.

Figure 6:
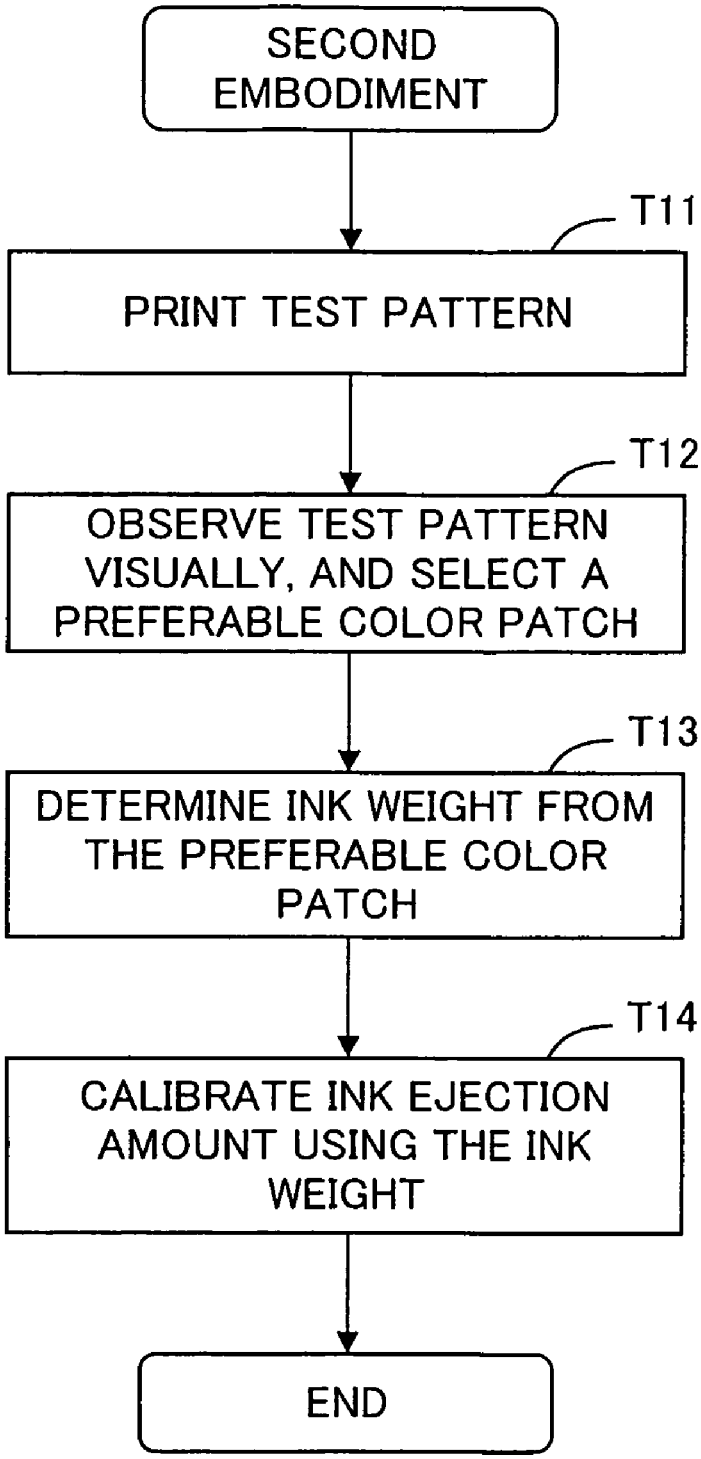
FIG. 6 is flow chart that shows the procedure for calibrating the ink ejection amount for the second embodiment.

B. Second Embodiment:

FIG. 6 is a flow chart that shows the procedure for calibrating the ink ejection amount in a second embodiment. The device structure of the second embodiment is the same as that of the first embodiment, and the differences from the first embodiment are the arrangement of the color patches within the test pattern and the method of selecting the preferable color patch.

In step T11 of FIG. 6, the two types of test patterns TP1 and TP2 like those shown in FIGS. 7A and 7B are printed. The first test pattern TP1 is used for determining the ink weight of the cyan nozzle array of the second print head 320B, and the second test pattern TP2 is used for determining the ink weight of the cyan nozzle array of the third print head 320C. For the other inks as well, the same kind of test patterns are respectively printed. The two test patterns TP1 and TP2 have the same color patch arrangement, and only the arrangement of the first test pattern TP1 will be described below.

The numbers noted in each of the color patches in FIG. 7A are the value of the dot recording rate DR of each color patch. These numbers are actually not depicted within the color patch, but rather are illustrations for purposes of explanation. The topmost color patch row of the first test pattern TP1 is printed using the cyan nozzle array of the first print head 320A, and all are printed at the same reference dot recording rate (here this is 10%). Hereafter, color patches printed with a reference nozzle array in this way are also called "reference color patches." The second color patch row is printed using the cyan nozzle array of the second print head 320B, and the dot recording rate increases sequentially by a fixed difference (here this is 0.1%) each from the left side toward the right. Color patches printed using the cyan nozzle array subject to testing in this way are called "test color patches." The third and fifth rows from the top are the same reference color patches as the topmost row, and the fourth row is the same test color patch row as the second row.

The test pattern TP1 has rows of reference color patches that are printed at a fixed reference dot recording rate (=10%) using a reference nozzle array, and rows of test color patches that are printed at sequentially changing dot recording rates using a nozzle array subject to testing; these two kinds of color patch rows are aligned alternately. The dot recording rate DR noted on the top of the test pattern TP1 shows the value for the test color patch.

The ink weight W of the cyan nozzle array of the second print head 320B is determined by visually selecting a color patch column or a vertical color patch group that looks like a uniform color (or uniform density) among the color patch columns in the test pattern TP1. With the example in FIG. 7A, the color of the plurality of color patches within the second vertical color patch group from the left side (position for which the dot recording rate DR for the test color patch is 9.8%) is the same. In other words, the dot recording rate DR of the test color patch that reproduces the same color as the reference color patch is 9.8%. In the second embodiment, the test color patch that reproduces the same color as the reference color patch is called the "preferable color patch." With the relationship in FIG. 5B described above, the dot recording rate DR of 9.8% corresponds to an ink weight W of 102%. Therefore, the ink weight W of the cyan nozzle array of the second print head 320B is set at 102%. Similarly, with the second test pattern TP2 shown in FIG. 7B, the color of the plurality of color patches within the third vertical color patch group from the left side (array for which the dot recording rate DR for the test color patch is 9.9%) is the same. In this case, the dot recording rate DR of the preferable color patch is 9.9%, so the ink weight W of the cyan nozzle array of the third print head 320C is set at 101%.

In order to visually select a vertical color patch group that appears to have uniform color, it is preferable that the horizontal color patch rows are arranged such that they have no gaps between the rows; in other words, the horizontal color patch rows are preferably arranged in a mutual contact state.

In the second embodiment described above, a preferable color patch is selected by visually comparing the color of the reference color patch and the color of a plurality of test color patches, and the ink weight W of each of the nozzle arrays is determined from the dot recording rate of that preferable color patch. Therefore, even when it is not possible to use a color measuring device such as a scanner or a calorimeter, it is possible to perform calibration of the ink ejection amount. In specific terms, it is possible to easily perform calibration of the ink ejection amount in the printer use environment after the printer has been shipped.

Even in the second embodiment, it is possible to select a preferable color patch by measuring color specification values of the reference color patch and the test color patch and using these color specification values. For the reference color patch, it is also possible to use a color patch that was printed in advance on a printing medium using another reference printer as the reference color patch, for example, without requiring printing using the print head that is provided on the print head unit 310. However, if the reference color patch is printed using the print head provided on the print head unit 310, there is the advantage that it is not necessary to prepare a reference color patch in advance.

Figure 8:
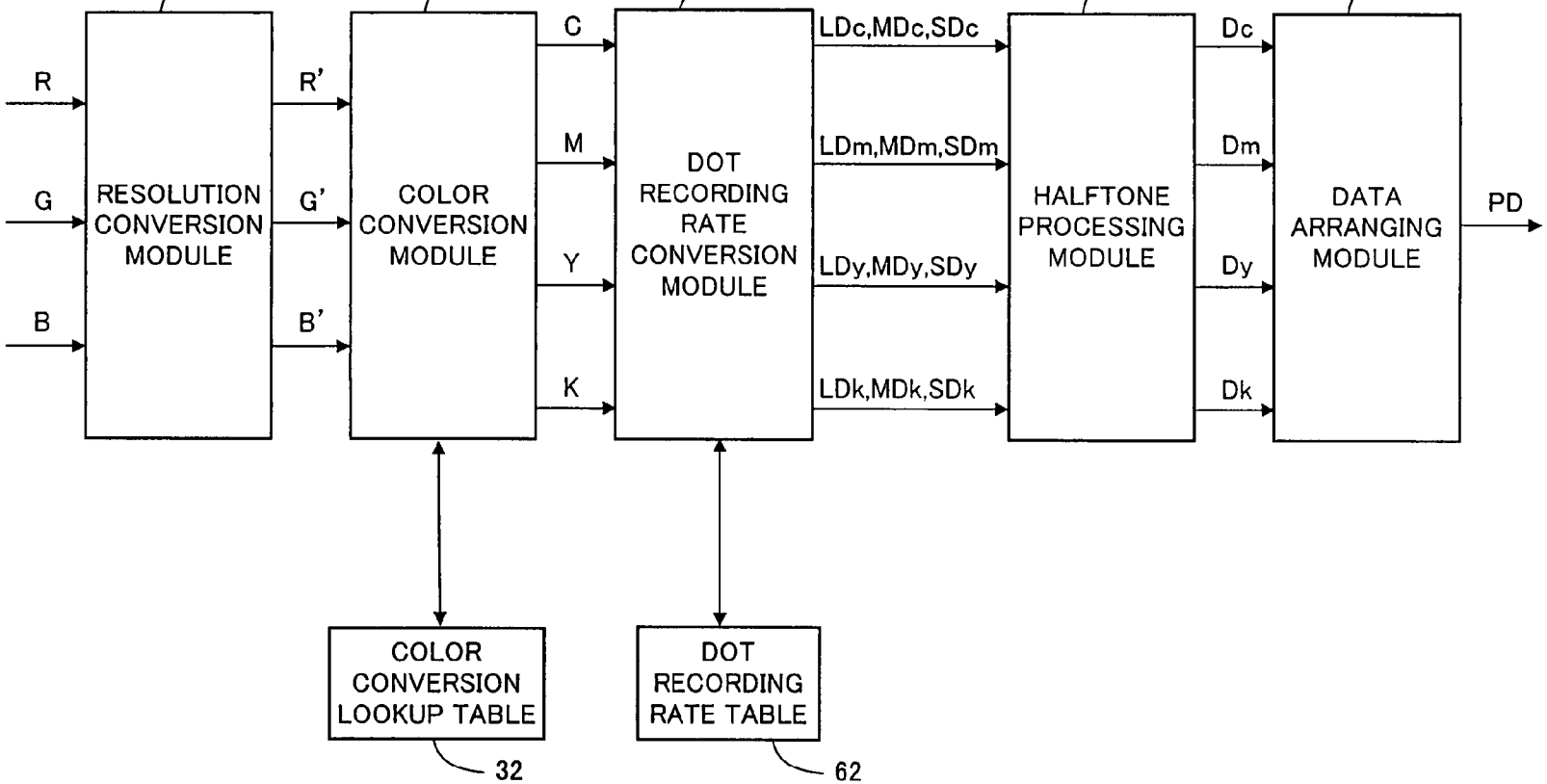
FIG. 8 is a block diagram that shows the structure of the print data generating unit of the third embodiment.

C. Third Embodiment:

FIG. 8 is a block diagram that shows the structure of the print data generation unit 250*a* in a third embodiment. The difference from the print data generation unit 250 of the first embodiment shown in FIG. 2 is only that a dot recording rate conversion module 60 and a dot recording rate table 62 have been added between the color conversion module 30 and the halftone processing module 40, and the rest of the structure is the same as that of the first embodiment.

Figure 9:
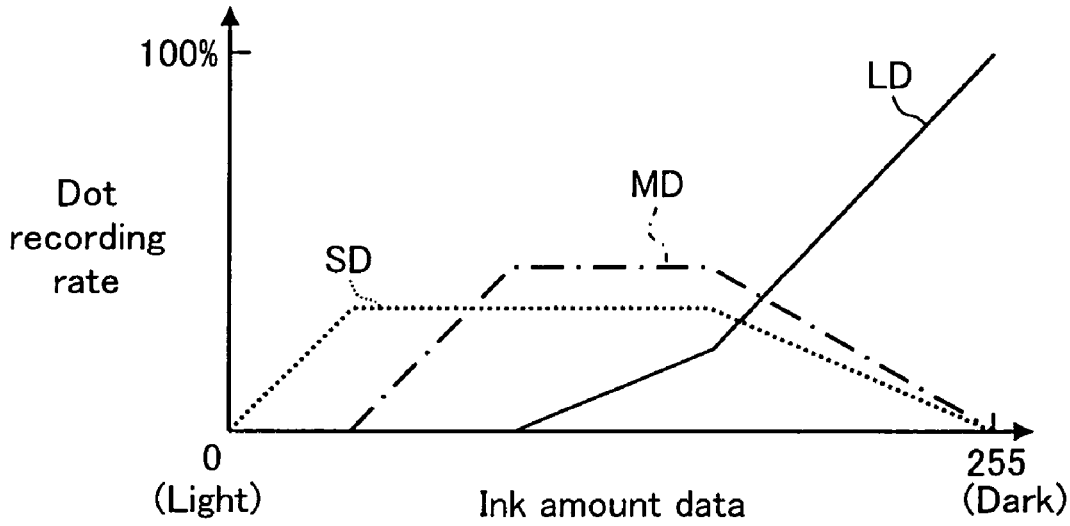
FIG. 9 schematically shows the contents of a dot recording rate table.

FIG. 9 shows the conversion characteristics of the dot recording rate table 62. The horizontal axis is ink amount data as input, and the vertical axis is the dot recording rate as output. In other words, the dot recording rate table 62 is a lookup table that has ink amount data as input and that has dot recording rates for three types of dots, small dots SD, medium dots MD, and large dots LD, as output.

When it is possible to record multiple ink dots of various sizes as dots of the same ink, it is preferable to calibrate the ink ejection amount for each ink dot size. At this time, each of the color patches shown in FIG. 5A or FIGS. 7A and 7B is printed using only ink dots of one size of one nozzle array. Then, the ink weight or the ink ejection amount error is determined for each ink dot size of each nozzle array.

In the third embodiment, calibration of the ink ejection amount is preferably performed by calibrating the dot recording rate of each dot size that is the output of the dot recording rate table 62. By doing this, it is possible to calibrate the ink ejection amount for each dot size of each ink, so it is possible to realize more precise calibration.

D. Variations:

D1. Variation 1:

FIG. 5A and FIGS. 7A and 7B are simply examples of test patterns, and it is possible to use other various arrangements as the color patch arrangement within a test pattern.

D2. Variation 2:

In the first embodiment, the preferable color patch having a suitable density is determined for each nozzle array based on the color specification value of the color patch, and the ink ejection amount error is determined from the dot recording rate of this preferable color patch, but the ink ejection amount error may be directly calculated from the color specification value of the preferable color patch. For example, it is possible to determine in advance the relationship between the color specification value and the ink ejection amount error for each ink, and by referencing this relationship, to obtain the ink ejection amount error from the color specification value. To say this more generally, it is possible to obtain the ink ejection amount error of a certain nozzle array based on the color specification value of a color patch printed using only that nozzle array.

Figure 10:
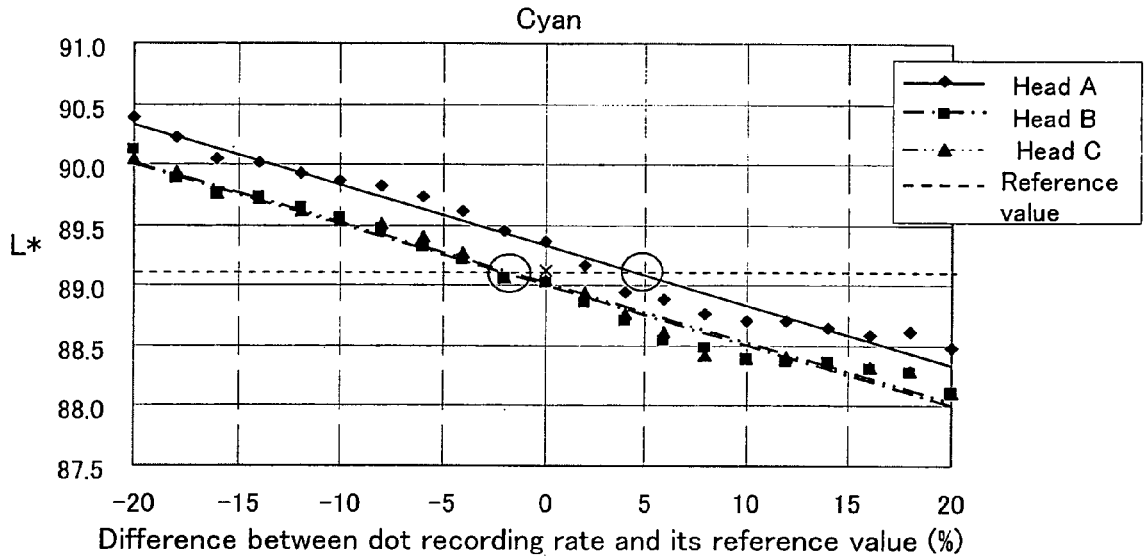
FIG. 10 is a graph that shows the approximation straight line of the relationship between the dot recording rate and the colorimetric value.

Also, instead of using the measured color specification value, it is also possible to use a color specification value that takes into consideration a measurement error. FIG. 10 is a graph that shows an example of a method of determining a color specification value that takes into consideration a measurement error. The horizontal axis shows the difference between the color patch dot recording rate and the reference dot recording rate, and the vertical axis shows the lightness value L* of the CIE-Lab color system. With this graph, measurement points are plotted that show the relationship of the dot recording rate and the color specification value for several color patches printed with the cyan nozzle array of three print heads. Also, the relationship of the dot recording rate and the color specification value for each print head is respectively approximated by a straight line. These approximation straight lines show the relationship between the "color specification value considering the measurement error" and the dot recording rate. Here, the reference color specification value is assumed to be the value shown by the dotted line, which is L*=89.1. In this case, the dot recording rate that corresponds to the color specification value that is closest to the reference color specification value, as shown by the circle in the FIG. 10, is (reference value +5%) for the first print head 320A, and is (reference value −2%) with the second and third print heads 320B and 320C. As a result, the ink weight W of the first print head 320A is 95%, and the ink weight W of the second and third print heads 320B and 320C is 102%. In this way, if the color specification value considering the measurement error is used, it is possible to obtain the ink ejection amount error more precisely. Also, if the approximation straight line (or approximation curve) is used to determine the color specification value considering the measurement error, it is possible to obtain an accurate ink ejection amount error with fewer color patches.

D3. Variation 3:

In the embodiments described above, a plurality of print heads are provided on the print head unit, but the present invention is also applicable to a printer that has only one print head. However, in this case, that single print head is preferably provided with a plurality of nozzle arrays for ejecting the same ink.

Figure 11:
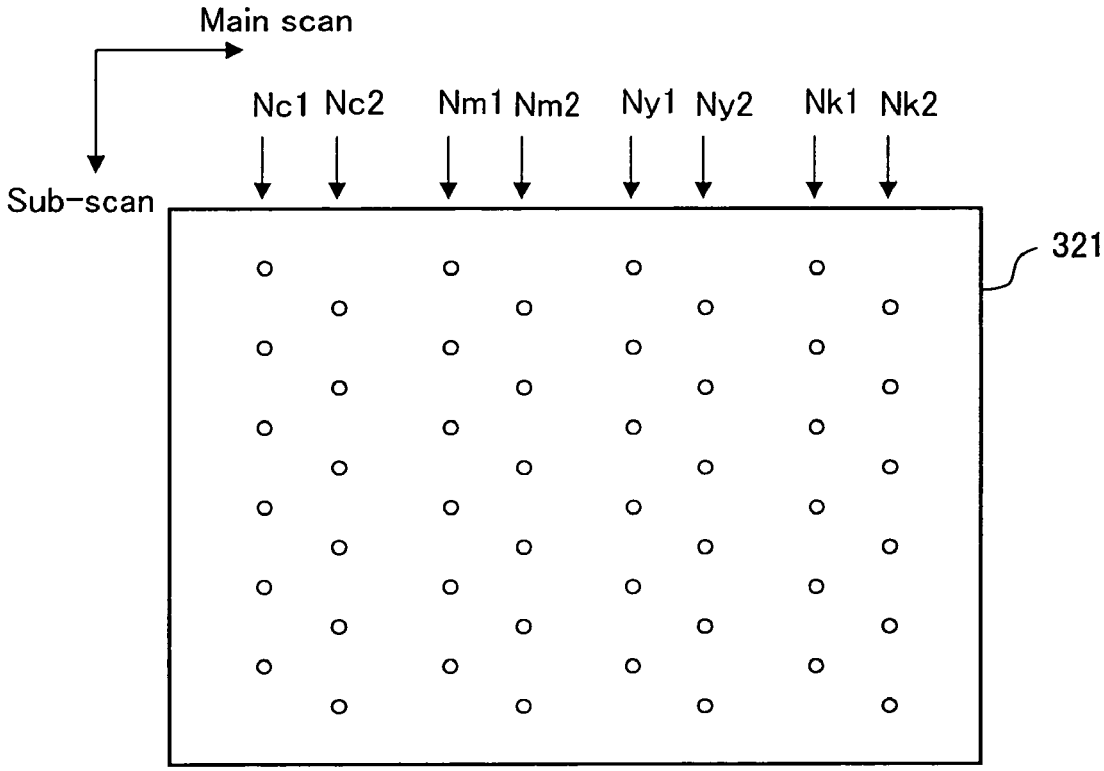
FIG. 11 schematically shows a variation of a print head.

FIG. 11 shows an example of a print head 321 that has two nozzle arrays for each of the inks. This print head 321 has two nozzle arrays Nc1 and Nc2 for cyan, two nozzle arrays Nm1 and Nm2 for magenta, two nozzle arrays Ny1 and Ny2 for yellow, and two nozzle arrays NK1 and NK2 for black. Also, the two nozzle arrays for each ink are arranged in zigzag in the sub-scan direction. For a printer that comprises a print head unit that has only one print head 321 in this way, it is possible to respectively determine the ink weight or ink ejection amount error for each of the eight nozzle arrays. In this case, for example if the ink ejection amount error for the two nozzle arrays Nc1 and Nc2 for cyan ink are different, it is possible to determine the ink weight of each cyan nozzle array using the same method as the embodiment described above.

Alternatively, for the print head of FIG. 11, it is also possible to obtain one ink weight information for two nozzle arrays (e.g. Nc1 and Nc2) that eject the same ink. In this case, it is possible to think of the printing head 321 of FIG. 11 has having the four nozzle arrays for four types of ink, so in terms of this point, this corresponds to one print head 320A shown in FIG. 3.

When a print head unit 310 is assembled using a plurality of print heads manufactured independently as shown in FIG. 3, the ink ejection amount errors for the individual print heads tend to cause a problem. Therefore, the present invention has a marked effect especially when applied to printers that comprise a print head unit having a plurality of print heads.

D4. Variation 4:

In the embodiments noted above, the four types of ink of C, M, Y, and K are used, but it is also possible to use any combination of inks other than the four inks. For example, in addition to cyan ink and magenta ink, it is also possible to use light cyan ink (relatively low density cyan ink) and light magenta ink (relatively low density magenta ink).

D5. Variation 5:

Although ink dots of three different sizes of large, medium, and small are available in the third embodiments noted above, the number of ink sizes is not limited to this, and the present invention is applicable to a case where a plurality of ink dots of different sizes are available.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of determining an ink ejection amount error for a printer that comprises a print head unit having a plurality of same ink nozzle arrays for ejecting same ink, the method comprising:

(a) printing a plurality of color patches with mutually different dot recording rates using one same ink nozzle array, with respect to each of the plurality of same ink nozzle arrays;

(b) measuring color specification values of this plurality of color patches for each same ink nozzle array; and (c) determining the ink ejection amount error of each same ink nozzle array based on the color specification values of the plurality of color patches for each same ink nozzle array.

2. A method claimed in claim 1, wherein the step (c) includes:

(i) obtaining, with respect to each same ink nozzle array, an average color specification value of selected color patches selected among the plurality of color patches printed with each same ink nozzle array;

(ii) selecting a preferable color patch for each same ink nozzle array among this plurality of color patches printed with the same ink nozzle array, the preferable color patch having a color specification value that is closest to the average color specification value; and (iii) determining the error ink ejection amount error of each same ink nozzle array based on the dot recording rate with which the preferable color patch is printed.

3. A method claimed in claim 1, wherein the step (c) includes:

(i) selecting a preferable color patch for each same ink nozzle array among this plurality of color patches printed with each same ink nozzle array, the preferable color patch having a color specification value that is closest to a predetermined reference value; and (ii) determining the error ink ejection amount error of each same ink nozzle array based on the dot recording rate with which the preferable color patch is printed.

4. A method claimed in claim 1, wherein each same ink nozzle array is capable of recording a plurality of sizes of ink dots, the step (a) includes printing a plurality of color patches with mutually different dot recording rates using only one ink dot size, with respect to each ink dot size, and the step (c) includes determining the ink ejection amount error with respect to each ink dot size for each same ink nozzle array.

5. A method claimed in claim 1, wherein the print head unit includes a plurality of print heads each having one of the same ink nozzle arrays, and the step (c) includes determining the ink ejection amount error for each of the print heads.

6. A method of determining the ink ejection amount error for a printer that comprise a print head unit having a plurality of same ink nozzle arrays for ejecting same ink, the method comprising:

(a) printing a plurality of color patches with mutually different dot recording rates using one same ink nozzle array, with respect to each of the plurality of same ink nozzle arrays;

(b) selecting a preferable color patch with respect to each same ink nozzle array among the plurality of color patches printed with the same ink nozzle array, the preferable color patch having a same color as a predetermined reference color patch; and (c) determining the ink ejection amount error of each same ink nozzle array based on the dot recording rate with which the preferable color patch is printed.

7. A method claimed in claim 6, wherein the reference color patch is printed at a specific dot recording rate using one specific reference nozzle array of the plurality of same ink nozzle arrays.

8. A method claimed in claim 7, wherein this step (a) includes printing a test pattern including:

a reference color patch row in which the reference color patch is repeatedly arranged; and a test color patch row formed by a plurality of color patches of mutually different dot recording rates printed with a same ink nozzle array other than the reference nozzle array, the test color patch row being arranged adjacent to the reference color patch row, and the step (b) includes selecting, among the color patches in the test color patch rows, the preferable color patch that has the same color as the reference color patch row.

9. A method claimed in claim 6, wherein each same ink nozzle array is capable of recording a plurality of sizes of ink dots, the step (a) includes printing a plurality of color patches with mutually different dot recording rates using only one ink dot size, with respect to each ink dot size, and the step (c) includes determining the ink ejection amount error with respect to each ink dot size for each same ink nozzle array.

10. A method claimed in claim 6, wherein the print head unit includes a plurality of print heads each having one of the same ink nozzle arrays, and the step (c) includes determining the ink ejection amount error for each of the print heads.

11. A printing device for forming ink dots on a printing medium while scanning a print head unit that has a plurality of same ink nozzle arrays for ejecting same ink along the main scan direction, the device comprising:

a printing unit configured to print a plurality of color patches with mutually different dot recording rates using one same ink nozzle array, with respect to each of the plurality of same ink nozzle arrays;

a measurement unit configured to measure color specification values of this plurality of color patches for each same ink nozzle array; and an error determination unit configured to determine an ink ejection amount error of each same ink nozzle array based on the color specification values of the plurality of color patches for each same ink nozzle array.

* * * * *